US007816592B2

(12) United States Patent
Babicz

(10) Patent No.: US 7,816,592 B2
(45) Date of Patent: Oct. 19, 2010

(54) STRINGED INSTRUMENT STRING ACTION ADJUSTMENT

(76) Inventor: Jeffrey T. Babicz, 46 Fletcher Dr., Newburgh, NY (US) 12550

( * ) Notice: Subject to any disclaimer, the term of this patent is extended or adjusted under 35 U.S.C. 154(b) by 0 days.

(21) Appl. No.: 12/482,829

(22) Filed: Jun. 11, 2009

(65) Prior Publication Data

US 2009/0308221 A1 Dec. 17, 2009

Related U.S. Application Data

(60) Provisional application No. 61/061,750, filed on Jun. 16, 2008.

(51) Int. Cl.
*G10D 3/00* (2006.01)

(52) U.S. Cl. ..... 84/293; 84/291; 84/267

(58) Field of Classification Search ..... 84/267, 84/291, 293
See application file for complete search history.

(56) References Cited

U.S. PATENT DOCUMENTS

| | | | | | |
|---|---|---|---|---|---|
| 457,996 | A | | 8/1891 | Kraske | |
| 1,671,942 | A | | 5/1928 | Strupe | |
| 1,707,192 | A | | 3/1929 | Overton | |
| 1,755,019 | A | * | 4/1930 | Parker Jr. | 84/293 |
| 2,793,556 | A | * | 5/1957 | Maccaferri | 84/267 |
| 3,196,730 | A | * | 7/1965 | Francis | 84/293 |
| 3,251,257 | A | | 5/1966 | Bunker | |
| 3,439,570 | A | * | 4/1969 | Emerson | 84/293 |
| 3,550,496 | A | * | 12/1970 | Fender | 84/293 |
| 3,657,462 | A | * | 4/1972 | Robinson | 84/723 |
| 3,915,049 | A | * | 10/1975 | Bean | 84/743 |
| 4,295,403 | A | | 10/1981 | Harris | |
| 4,432,267 | A | * | 2/1984 | Feller | 84/293 |
| 4,793,236 | A | * | 12/1988 | McGuire et al. | 84/293 |
| 4,896,578 | A | * | 1/1990 | Marx | 84/313 |
| 5,018,423 | A | | 5/1991 | Bunker et al. | |
| 5,421,233 | A | | 6/1995 | Bunker | |
| 5,458,035 | A | | 10/1995 | Okamura | |
| 5,679,910 | A | | 10/1997 | Steinberger et al. | |
| 6,051,766 | A | | 4/2000 | Taylor | |
| 6,262,353 | B1 | * | 7/2001 | Murray | 84/290 |
| 6,265,648 | B1 | * | 7/2001 | Steinberger | 84/293 |
| 6,353,164 | B1 | * | 3/2002 | Corsi | 84/293 |
| 6,664,453 | B2 | * | 12/2003 | Ito et al. | 84/293 |
| 6,831,218 | B2 | * | 12/2004 | Steinberger | 84/293 |
| 7,157,634 | B1 | * | 1/2007 | Babicz | 84/293 |
| 7,326,838 | B1 | | 2/2008 | Bunker | |

(Continued)

*Primary Examiner*—Jeffrey Donels
*Assistant Examiner*—Robert W Horn
(74) *Attorney, Agent, or Firm*—Joseph L. Spiegel; Heslin Rothenberg Farley & Mesiti P.C.

(57) ABSTRACT

A stringed musical instrument comprises: a headstock with tuners; a neck having a fingerboard, and a neck extension; a body having a top, a back, a longitudinal recess in the back for receipt of the neck extension and a bridge with a saddle secured to the body; and, one or more strings stretched from the headstock over the neck and fingerboard and over a portion of the top of the body to contact points on the bridge saddle. The instrument is further provided with a pivotal mount for mounting the neck to the body and a string action adjustment member for moving the neck lower extended end within the body longitudinal recess and thereby the position of the neck relative to the body, whereby the height of the strings are adjusted relative to the neck and its fingerboard.

7 Claims, 4 Drawing Sheets

U.S. PATENT DOCUMENTS

| | | | | |
|---|---|---|---|---|
| 7,465,859 | B2 * | 12/2008 | Kroeger et al. | 84/293 |
| 7,557,281 | B1 * | 7/2009 | Campling | 84/293 |
| 2009/0100981 | A1 * | 4/2009 | Chadwick, V | 84/293 |
| 2009/0151537 | A1 * | 6/2009 | Leach | 84/293 |
| 2009/0308221 | A1 * | 12/2009 | Babicz | 84/293 |
| 2010/0024623 | A1 * | 2/2010 | Kim | 84/293 |

* cited by examiner

STRINGED INSTRUMENT STRING ACTION ADJUSTMENT

CROSS-REFERENCE TO RELATED APPLICATION

The present application is related to Provisional Application Ser. No. 61/061,750 Jun. 16, 2008. This prior application is incorporated herein by this reference and the benefit of its filing date is claimed herein as well.

BACKGROUND OF THE INVENTION

1. Field of the Invention

This invention relates to stringed musical instruments, and, in particular to the adjustment of the instrument's string action.

2. Description of the Prior Art

Stringed musical instruments normally include the following elements: a headstock with tuners; a neck with fingerboard; a body; a bridge secured to the body with a saddle; and, one or mores strings stretched from the headstock over the neck and fingerboard and over a portion of the body to contact points on the bridge saddle.

The height of the strings relative to the neck and its fingerboard is generally referred to as the string's action. Often a musician will choose to have the instrument's action set to different heights depending on the type of music being played or playing style favored. Certain musicians prefer to have a small distance between the fingerboard and string or "low" action, while others prefer a "high" action for various reasons, one of which is to avoid fret buzzing. Action is subject to personal preference and can have a major affect on performance. The present invention is directed to a string instrument wherein the string's action is adjustable upon pivotal movement of the neck relative to the body, and wherein the body can be solid or hollow.

The prior art is replete with stringed musical instruments wherein the neck is pivotable relative to the instrument's body. Examples may be found in the following U.S. Pat. Nos. 7,362,838, Bunker; 6,831,218, Steinberger; 6,265,648, Steinberger; 6,051,766, Taylor; 5,679,910 Steinberger; 5,458,035, Okamura; 5,421,233, Bunker; 5,018,423, Bunker, et al.; 4,295,403, Harris; 3,251,257, Bunker; 2,793,556; Maccaferri 1,707,192, Overton; 1,671,942, Strupe; and, 457,996, Kraske.

However, the prior art arrangements wherein the neck is pivotable relative to the instrument's body suffer from the following disadvantages that are overcome by the present invention: do not adjust string action, is not instantly adjustable or requires disassembly or multiple adjustments; unsuitable for solid body instruments; degradation of the instrument; require excessive hardware or apparatus; and, may be difficult to produce in a production environment.

Another approach to adjustment of string action may be found in my U.S. Pat. No. 7,157,634, issued Jan. 2, 2007, but in this patent, there is no change in the angle of the neck relative to the instrument's body.

SUMMARY

Accordingly, a primary object of the present invention is improvement in adjustment of the string action in a string instrument wherein the neck is pivoted relative to the instrument's body.

These and other objects, features and advantages are accomplished in accordance with the teachings of the present invention, one illustrative embodiment of which comprises a stringed musical instrument with: a headstock with tuners; a neck having a fingerboard and a neck extension; a body having a top, a back, a longitudinal recess in the back for receipt of the neck extension and a bridge with a saddle secured to the body; and, one or more strings stretched from the headstock over the neck and fingerboard and over a portion of the top of the body to contact points on the bridge saddle. In accordance with the invention, the instrument is provided with a pivotal mount for mounting the neck to the body and a string action adjustment member for moving the neck extension within the body longitudinal recess and thereby the position of the neck relative to the body, whereby the height of the strings are adjusted relative to the neck and its fingerboard.

BRIEF DESCRIPTION OF THE DRAWING

Other objects, features and advantages of the present invention will be apparent from the following detailed description and accompany drawing, wherein.

DETAILED DESCRIPTION

Figure 1:
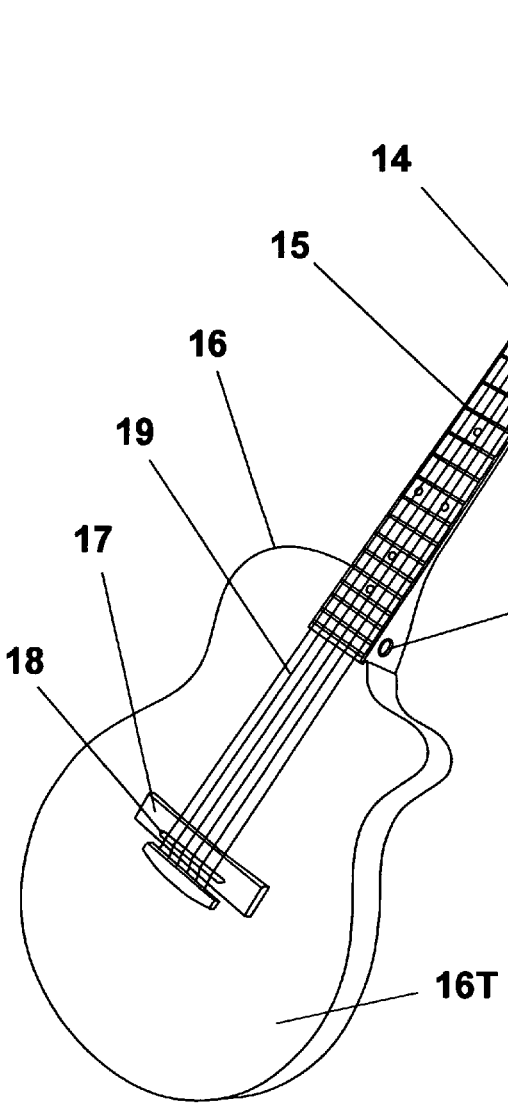
FIG. 1 is a perspective view of a stringed instrument incorporating the features of the present invention.

Referring now to FIG. 1 of the drawing there is illustrated a stringed instrument 10. The particular instrument shown is a guitar, but the invention is equally applicable to other stringed instruments such as mandolins, ukuleles, banjos, basses and the family of bowed instruments such as violin or cello. Instrument 10 is seen as including: a headstock 11 with tuning pegs or tuners 12; neck 13 with fingerboard 14 having frets 15; a body 16, in this case illustrated as being solid, with a top 16T and back 16B (See FIG. 2); a bridge 17 with a saddle 18 secured to the top of body 16T; and, one or more strings 19 stretched from the headstock 11 over the neck 13 and fingerboard 14 and over a portion of the top of the body 16T to contact points on the bridge saddle 18. The instrument 10 can have a body 16 that is solid, semi-hollow or a full acoustic chamber and may be of wood such as mahogany, maple, ash or alder. Body 10 can also be molded and cast in resin, or machined out of light metal such as aluminum or even fabricated out of sheet metal similar to a resonator guitar.

Figure 8:
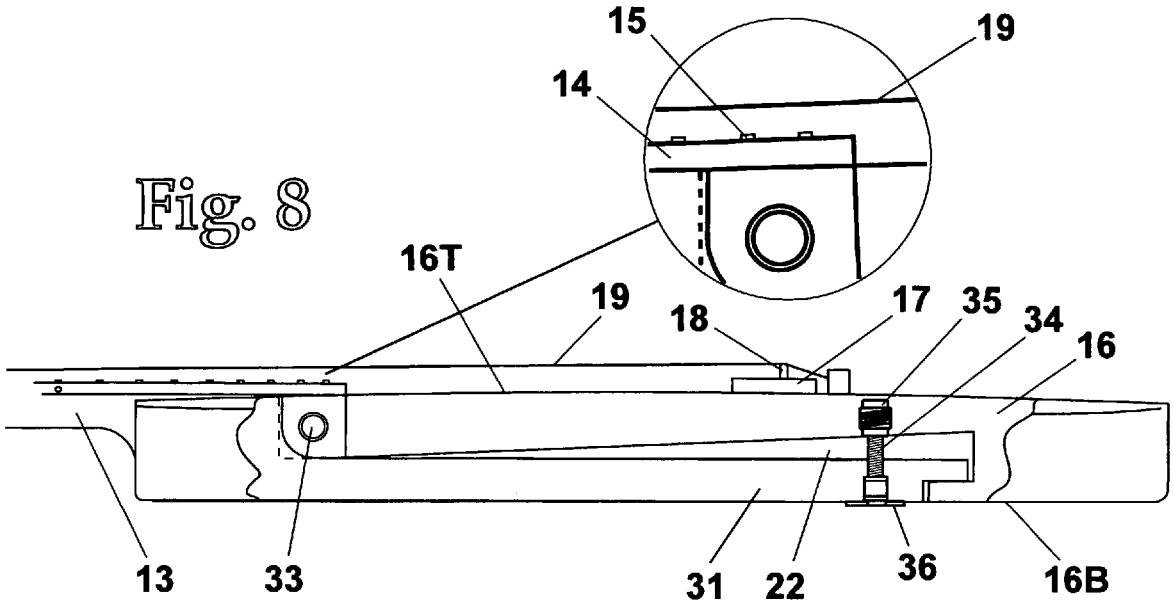
FIG. 8 is a partial, side view, partially cut away, and partially schematic, with string action at maximum; and, FIG. 9 is a partial, side view, partially cut away, and partially schematic, with string action at minimum.
Figure 9:
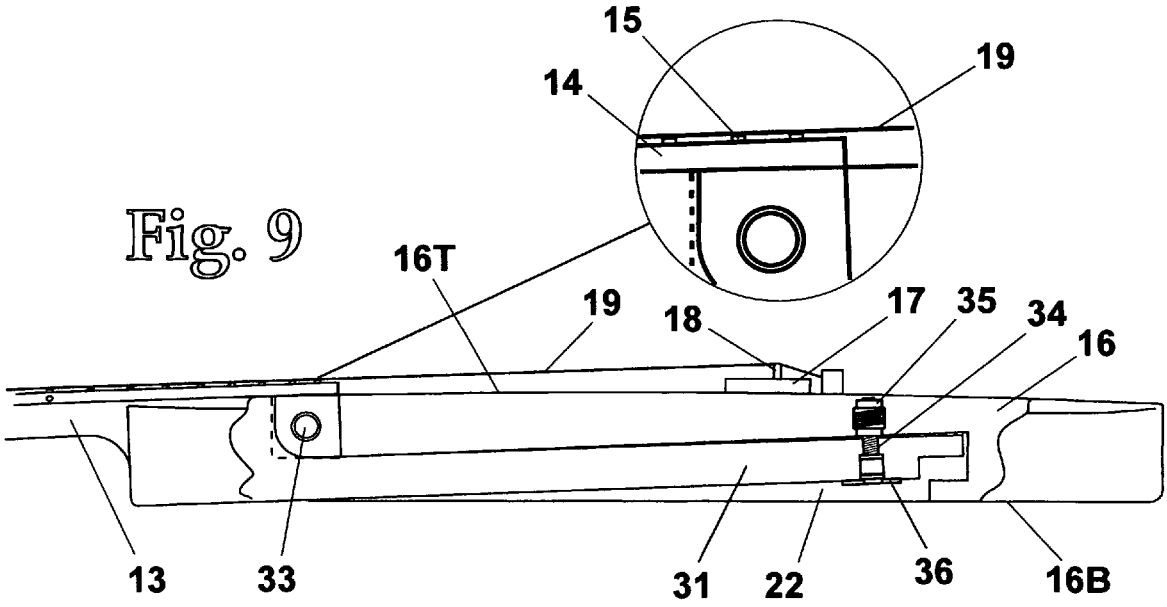

The invention is concerned with adjustment of the height of the strings 19 relative to the neck 13 and its fingerboard 14, commonly referred to as the string's action. FIG. 8 illustrates the strings 19 being at a maximum height above the frets 15 while FIG. 9 illustrates the minimum height of the strings 19 relative to the frets 15. The height of the strings 19 relative to the neck 13 and its fingerboard 14 is a matter of the musician's choice.

Figure 5:
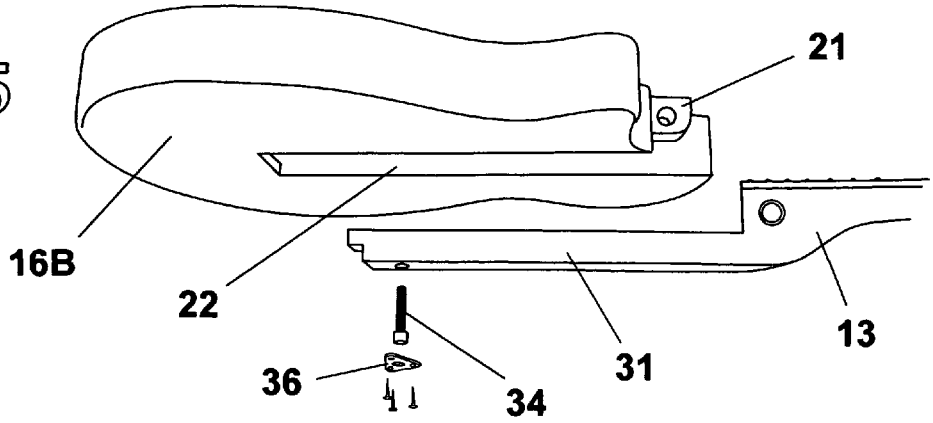
FIG. 5 is a partial, perspective view of the instrument's body and neck, prior to being mated.
Figure 6:
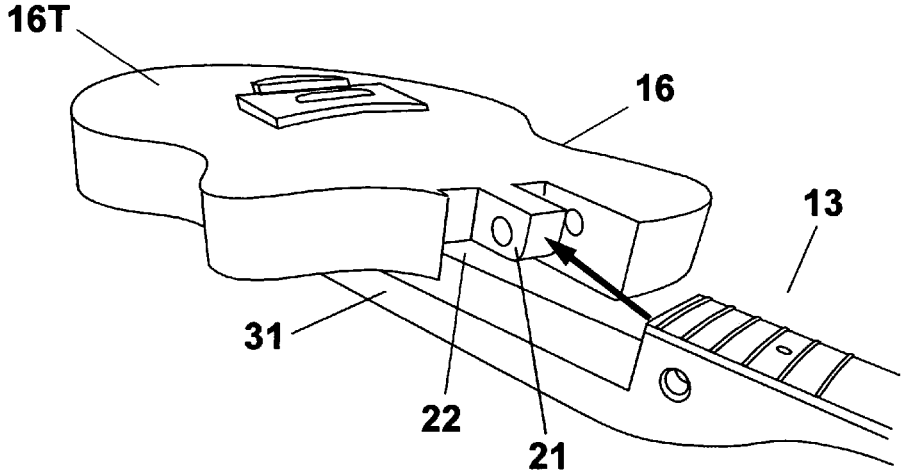
FIG. 6 is a partial perspective view showing the neck being slid into the instrument's body.

As best seen in FIGS. 5 and 6, the body 16 is provided with body tongue 21 and a longitudinal recess 22 in its back 16B.

Figure 3:
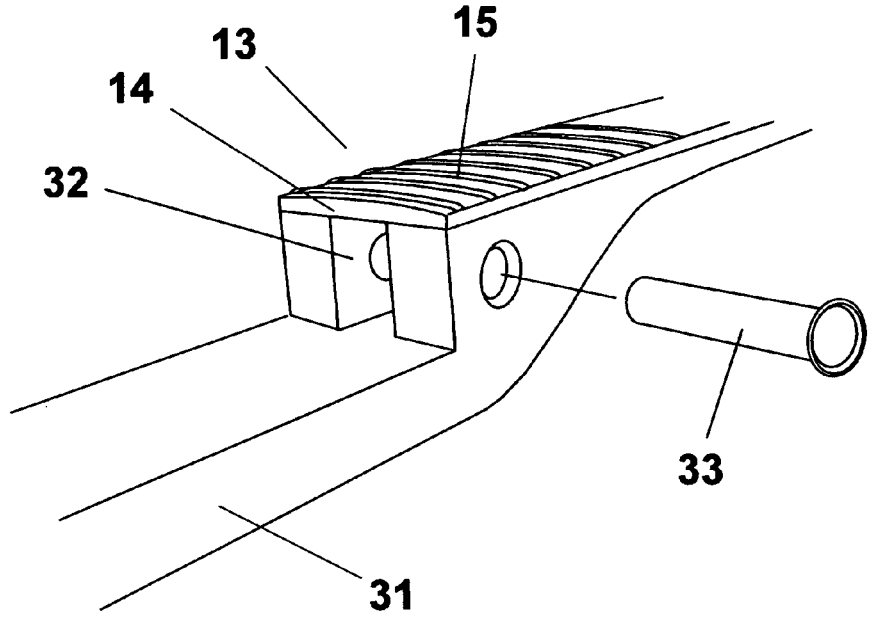
FIG. 3 is a partial, perspective view of the neck groove with pivot pin and neck extension.

As shown in FIGS. 3 through 6, neck 13 includes a neck extension 31 and groove 32. FIG. 3 is a partial, perspective view showing neck extension 31 on the neck 13, that will be fitted into the longitudinal recess 22 in the back 16B of the body 16. Also shown is the groove 32 of neck 13 that will receive the body tongue 21, FIGS. 5 and 6, of the body 16. Holes are drilled through the neck 13 at the groove 32 and through the body tongue 21, FIGS. 5 and 6, for receipt of a pin 33 that will allow pivotal movement of the neck 13 relative to the body 16. Together, the body tongue 21, groove 32 and pin 33 form a pivotal mount for mounting the neck 13 to the body 16.

Figure 4:
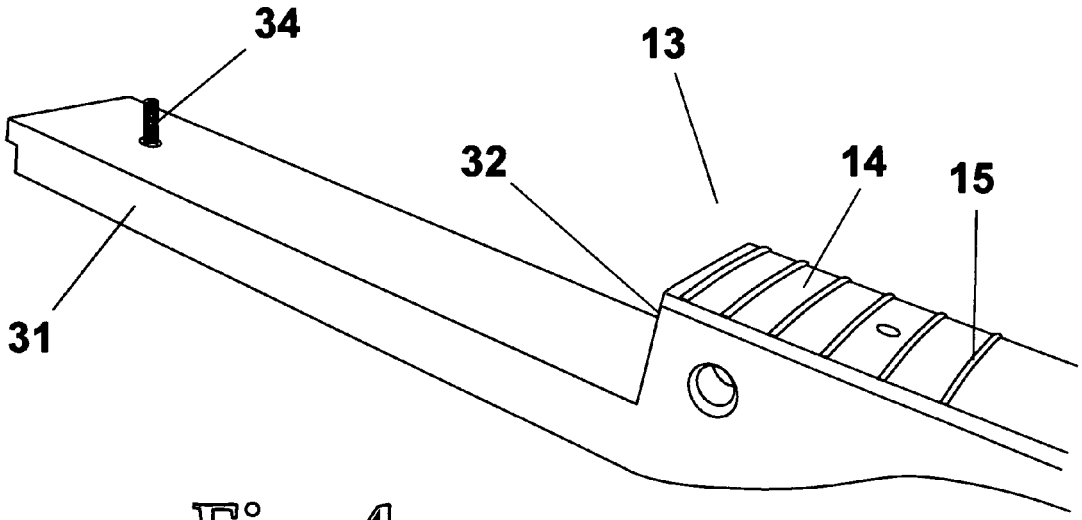
FIG. 4 is a partial perspective view of the neck showing a trap screw 34 protruding through a hole in the neck extension of the neck.

FIG. 4 is a partial perspective view of the neck 13 showing a trap screw 34 protruding through a hole in the neck extension 31, with the head of screw 34 bearing against the neck extension 31. The trap screw 34 is intended to be threaded into a trap screw insert 35 (FIGS. 8 and 9) embedded in the body 16 of the instrument 10, and, as will be explained hereafter, will lead to adjustment of the height of the strings 19 relative to the neck 13 and fingerboard 14.

Referring to FIG. 5, the neck 13 is mounted to the body 16 by fitting the neck extension 31 into the body recess 22. The body tongue 21 interlocks with the neck groove 32. A trap plate 36 fastened to the neck extension 31, over the head of the trap screw 34, restricts vertical motion of the trap screw 34 so that the screw's motion is limited to clockwise or counterclockwise direction, with no concurrent vertical displacement. Together, the trap screw 34, trap screw insert 35 and trap plate 36 form a string action adjustment member.

Referring to FIG. 6, the neck extension 31 portion of the neck 13 is slid into the recess 22 of the body 16. The body tongue 21 and neck groove 32 fit snugly together.

Figure 7:
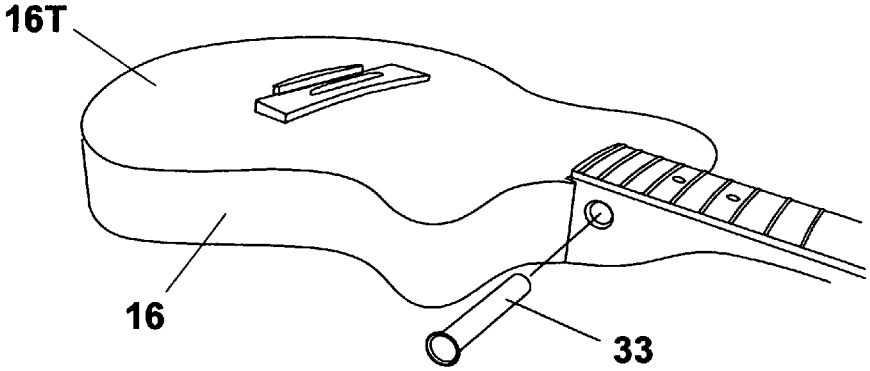
FIG. 7 is a partial perspective view showing insertion of the pivot pin through the neck and body tongue.

Referring to FIG. 7, after the trap screw 34 passes through the neck extension 31 and engages the trap screw insert 35 (FIGS. 8 and 9), and pin 33 is slid through the neck 13 and body tongue 21, making a strong neck-body joint.

Figure 2:
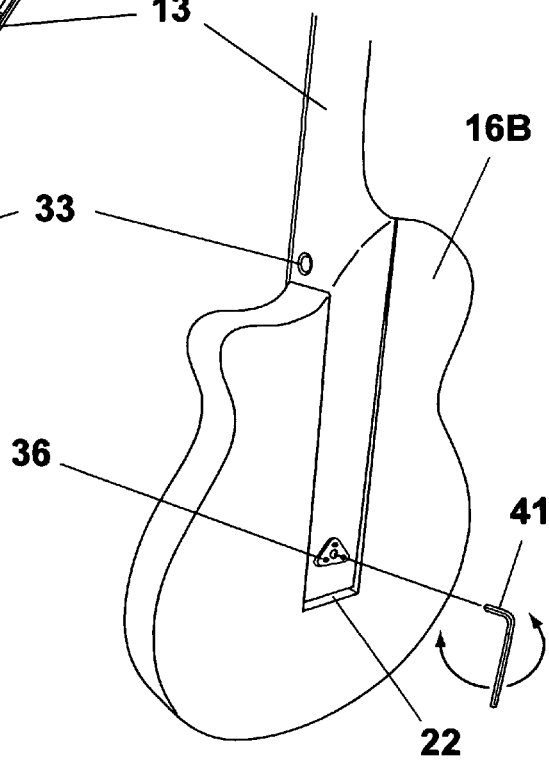
FIG. 2 is a partial, perspective view of the rear of the stringed instrument of FIG. 1.

In use, action adjustment is accomplished using a simple tool such as an Allen wrench 41, shown in FIG. 2. A counterclockwise turn of the screw 34 moves the neck extension 31 to as far as flush with the recess 22 of the body 16. The neck 13 pivots at the pin 33. Action is at maximum string height when the neck extension 31 is flush with the body 16. See FIG. 8.

Conversely, clockwise motion of the screw 34 causes the neck extension 31 to move into the body recess 22. The neck 13 pivots at the pin 33 Action is at minimum string height. See FIG. 9.

The invention allows for instant adjustment of string action of any variable range, without the need of de-tuning the instrument's strings or without the need for additional parts or hardware and without the need for disassembly of any part of the instrument. The invention takes full advantage of extending the length of the neck into the body, where leverage is most beneficial and the strong neck-body joint forces do not come into play. It should be obvious that changes, additions and omissions may be made in the details and arrangement of parts without departing from the spirit and scope of the invention as hereinafter claimed.

What is claimed is:

1. In a stringed musical instrument with a neck having a fretboard, a body having a top, back and bridge with a saddle secured to the body top and one or more strings stretched over the neck and fretboard and over a portion of the top of the body to contact points on the bridge saddle, the improvement that includes a mount for mounting the neck to the body without the need for screws, bolts and/or glue, the mount comprising a groove within the neck, a body tongue for fitting within the neck groove and a pin passing through the neck groove and body tongue.

2. The instrument of claim 1 including an adjustment member for moving the position of the neck relative to the body, the adjustment member including a single screw for turning and adjusting the neck-body relative position.

3. In a stringed musical instrument with a neck having a fretboard, a body having a top, back and bridge with a saddle secured to the body top and one or more strings stretched over the neck and fretboard and over a portion of the top of the body to contact points on the bridge saddle, the improvement wherein:

the neck has a lower extended end;

the back has a longitudinal recess for receipt of the neck lower extended end;

a pivotal mount for mounting the neck to the body; and, a string action adjustment member for moving the neck lower extended end within the body longitudinal recess and thereby the position of the neck relative to the body, whereby the height of the strings are adjusted relative to the neck and its fretboard.

4. The instrument of claim 3 wherein the neck includes a groove, the body includes a tongue for fitting within the neck groove, and the instrument further includes a pin passing through the neck groove and body tongue, the groove, tongue and pin together forming the pivotal mount for the instrument.

5. The instrument of claim 3 including a trap screw insert embedded in the body back within the recess, a trap screw passing through the neck extended lower end for threading into the trap screw insert and a trap plate fastened to the neck lower extended end over the trap screw for restricting vertical movement of the screw, the trap screw insert, trap screw and trap plate together forming the string action adjustment member.

6. The instrument of claim 3 wherein the instrument has a headstock with tuners and the strings extend from the headstock tuners.

7. The instrument of claim 3 wherein the body is solid.

* * * * *